US009328544B1

(12) United States Patent
Liang et al.

(10) Patent No.: US 9,328,544 B1
(45) Date of Patent: May 3, 2016

(54) HINGE DEVICE

(71) Applicants: KING SLIDE WORKS CO., LTD., Kaohsiung (TW); KING SLIDE TECHNOLOGY CO., LTD., Kaohsiung (TW)

(72) Inventors: Hsiu-Chiang Liang, Kaohsiung (TW); Ken-Ching Chen, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 0 days.

(21) Appl. No.: 14/670,675

(22) Filed: Mar. 27, 2015

(51) Int. Cl.
*E05D 7/00* (2006.01)
*E05D 11/10* (2006.01)
*E05F 3/20* (2006.01)

(52) U.S. Cl.
CPC ..... *E05D 7/00* (2013.01); *E05D 11/1014* (2013.01); *E05F 3/20* (2013.01); *Y10T 16/5383* (2015.01); *Y10T 16/53848* (2015.01)

(58) Field of Classification Search
CPC ..... Y10T 16/5383; Y10T 16/53832; Y10T 16/53833; Y10T 16/53848; Y10T 16/53843; Y10T 16/53607; Y10T 16/558; Y10T 16/304; Y10T 16/2771; Y10T 16/2777; E05D 11/1014; E05D 11/02; E05D 11/1021; E05D 7/0407; E05D 7/125; E05D 5/0276; E05D 7/00; E05F 3/20; E05F 5/006; E05Y 2800/70; E05Y 2800/412; E05Y 2900/20
USPC ..... 16/286–288, 296, 294, 262, 387, 50, 16/54, 56
See application file for complete search history.

(56) References Cited

U.S. PATENT DOCUMENTS 3,564,643 A * 2/1971 Salice ..... E05D 3/06 16/278
3,744,086 A * 7/1973 Salice ..... E05D 3/142 16/273
3,840,936 A * 10/1974 Sato ..... E05F 5/006 16/286
3,940,828 A * 3/1976 Lautenschlaeger . E05D 11/1021 16/288
4,114,237 A * 9/1978 Grass ..... E05D 11/1021 16/294
4,654,930 A * 4/1987 Lautenschlager, Jr. ..... E05D 11/1021 16/288
4,819,299 A * 4/1989 Holan ..... E05D 11/1014 16/278
5,008,977 A * 4/1991 Lautenschlager ... E05D 11/1021 16/278
5,022,117 A * 6/1991 Lautenschlager ... E05D 11/1021 16/288
5,027,474 A * 7/1991 Bowers ..... E05D 11/1014 16/297
5,029,362 A * 7/1991 Prodan ..... E05D 11/1021 16/236
5,355,557 A * 10/1994 Cress ..... E05D 11/1014 16/286
6,125,508 A * 10/2000 Formenti ..... E05D 5/08 16/278
6,401,298 B1 * 6/2002 Lenz ..... E05D 11/1021 16/303
6,845,544 B2 * 1/2005 Hofer ..... E05D 7/0415 16/242
8,689,402 B2 4/2014 Brunnmayr
2003/0093877 A1 * 5/2003 Hofer ..... E05D 7/0415 16/235
2004/0163211 A1 * 8/2004 Rucker ..... E05D 7/0415 16/235
2004/0226139 A1 * 11/2004 Salice ..... E05D 3/142 16/286

* cited by examiner

*Primary Examiner* — William Miller
(74) *Attorney, Agent, or Firm* — Rosenberg, Klein & Lee

(57) ABSTRACT

A hinge device includes a fitting, a connecting arm, a cam, an elastic member, and a sleeve member. The connecting arm is pivotally connected to the fitting. The cam is located at the connecting arm. The elastic member is mounted to the fitting and includes an end portion having a non-circular cross section. The sleeve member is attached to the elastic member and is in contact with the cam. The sleeve member includes a cavity in which the end portion of the elastic member can be mounted.

14 Claims, 11 Drawing Sheets

HINGE DEVICE

FIELD OF THE INVENTION

The present invention relates to a hinge and more particularly to a hinge device for use as a furniture hinge and having an elastic member which is in contact with a cam via a sleeve member.

BACKGROUND OF THE INVENTION

Furniture such as doors and cabinets is generally mounted with hinges by means of which a movable member of the furniture can be opened or closed with respect to the main body of the furniture. For example, the Background of the Invention section of the specification of U.S. Pat. No. 8,689,402 B2 states that a furniture hinge typically includes a spring for generating a closing and/or opening force and that, however, the spring may break after the furniture hinge has been used for a while. To overcome this drawback of the conventional furniture hinges, the aforesaid patent discloses a furniture hinge with a sliding element. More specifically, the furniture hinge (100) disclosed in the embodiments and drawings (e.g., FIG. 1, FIG. 2, FIG. 3*a*, FIG. 3*b*, and FIG. 6) of the aforesaid patent has a fitting (101) and a hinge cup (102) to be opened or closed with respect to each other. The furniture hinge (100) also includes a spring (2) having an end portion mounted with a sliding element (1). When the hinge cup (102) is opened or closed with respect to the fitting (101), the end portion of the spring (2) is in movable contact with a cam (3) via the sliding element (1). According to this arrangement, the end portion of the spring (2) is in contact with the cam (3) via the sliding element (1) and is therefore less likely to break than its prior art counterparts. Nevertheless, the furniture hinge (100) has its shortcomings as explained below. The end portion of the spring (2, 12) has a circular cross section, and the sliding element (1, 11) has a cylindrical cavity corresponding to the circular cross section so that the end portion of the spring (2, 12) can be mounted in the cavity. To ensure that the sliding element (1, 11) stays in place with respect to the spring (2, 12), the sliding element (1, 11) is engaged in the coils of the spring (2, 12) via an attachment device (4, 14). Obviously enough, the sliding element (1, 11) will fall off the spring (2, 12) if the attachment device (4, 14) is absent. On the other hand, while a circle-to-circle mounting design is used for connecting the sliding element and the spring, the support point is engaged in the coils of the spring via the attachment device of the sliding element. If the mounting tolerance of the support point is improper in relation to the contact angle between the cam and the sliding element, the quality of use of the hinge will be compromised.

It can be known from the above that the mounting and positioning methods of the sliding element affect the quality of use. As the assembly of the various components of a hinge device may have different requirements, the connection between the sliding element and the spring should be taken into account to meet practical needs.

SUMMARY OF THE INVENTION

The present invention relates to a furniture hinge in which a sleeve member and an elastic member are securely connected to each other.

According to one aspect of the present invention, a hinge device includes a fitting, a connecting arm, a cam, an elastic member, and a sleeve member. The connecting aim is pivotally connected to the fitting. The cam is located at the connecting arm. The elastic member is mounted to the fitting and includes an end portion having a non-circular cross section. The sleeve member is attached to the elastic member and is in contact with the cam. The sleeve member includes a cavity in which the end portion of the elastic member can be mounted.

According to another aspect of the present invention, a hinge device includes a fitting, a connecting arm, an elastic member, and a sleeve member. The connecting arm is pivotally connected to the fitting. The elastic member is mounted to the fitting and includes an end portion having a non-circular cross section. The sleeve member is attached to the elastic member and is in contact with the connecting arm. The sleeve member includes a cavity in which the end portion of the elastic member can be mounted. The fitting is able to be driven to pivot with respect to the connecting arm by an elastic force generated by the elastic member.

According to still another aspect of the present invention, a hinge device adapted to be mounted to a piece of furniture is provided, wherein the furniture includes a first furniture member and a second furniture member. The hinge device includes a first fitting, a second fitting, a connecting arm, a cam, an elastic member, and a sleeve member. The first fitting is mounted to the first furniture member. The second fitting is mounted to the second furniture member. The connecting arm pivotally connects the first fitting and the second fitting. The cam is located at the connecting arm. The elastic member is mounted to one of the first fitting and the second fitting and includes an end portion having a non-circular cross section. The sleeve member is attached to the elastic member and is in contact with the cam. The sleeve member includes a cavity in which the end portion of the elastic member can be mounted.

In some embodiments of any of the foregoing aspects, the hinge device further includes another fitting connected to the connecting arm.

In some embodiments of any of the foregoing aspects, the elastic member further includes another end portion and a coil portion connected between the end portion and the another end portion; the coil portion of the elastic member defines a mounting hole, and the hinge device further includes a connecting member passing through the mounting hole in order to mount the elastic member to the fitting; and the another end portion of the elastic member is pressed against the fitting.

In some embodiments of any of the foregoing aspects, the elastic member includes a portion other than the end portion and having a non-circular cross section.

In some embodiments of any of the foregoing aspects, the cavity of the sleeve member is a non-circular cavity.

In some embodiments of any of the foregoing aspects, the cavity of the sleeve member includes a first portion and a second portion, the first portion has a greater diameter than the second portion, and the second portion has a smaller width than the end portion of the elastic member.

In some embodiments of any of the foregoing aspects, the first portion of the cavity of the sleeve member has a diameter substantially equal to a width of the end portion of the elastic member.

One advantage of the present invention is that the elastic member of the furniture hinge is in contact with the cam via the sleeve member, and that due to its non-circular cross section, the end portion of the elastic member can effectively secure the sleeve member in position in the peripheral direction of the end portion of the elastic member.

DETAILED DESCRIPTION OF THE INVENTION

Figure 1:
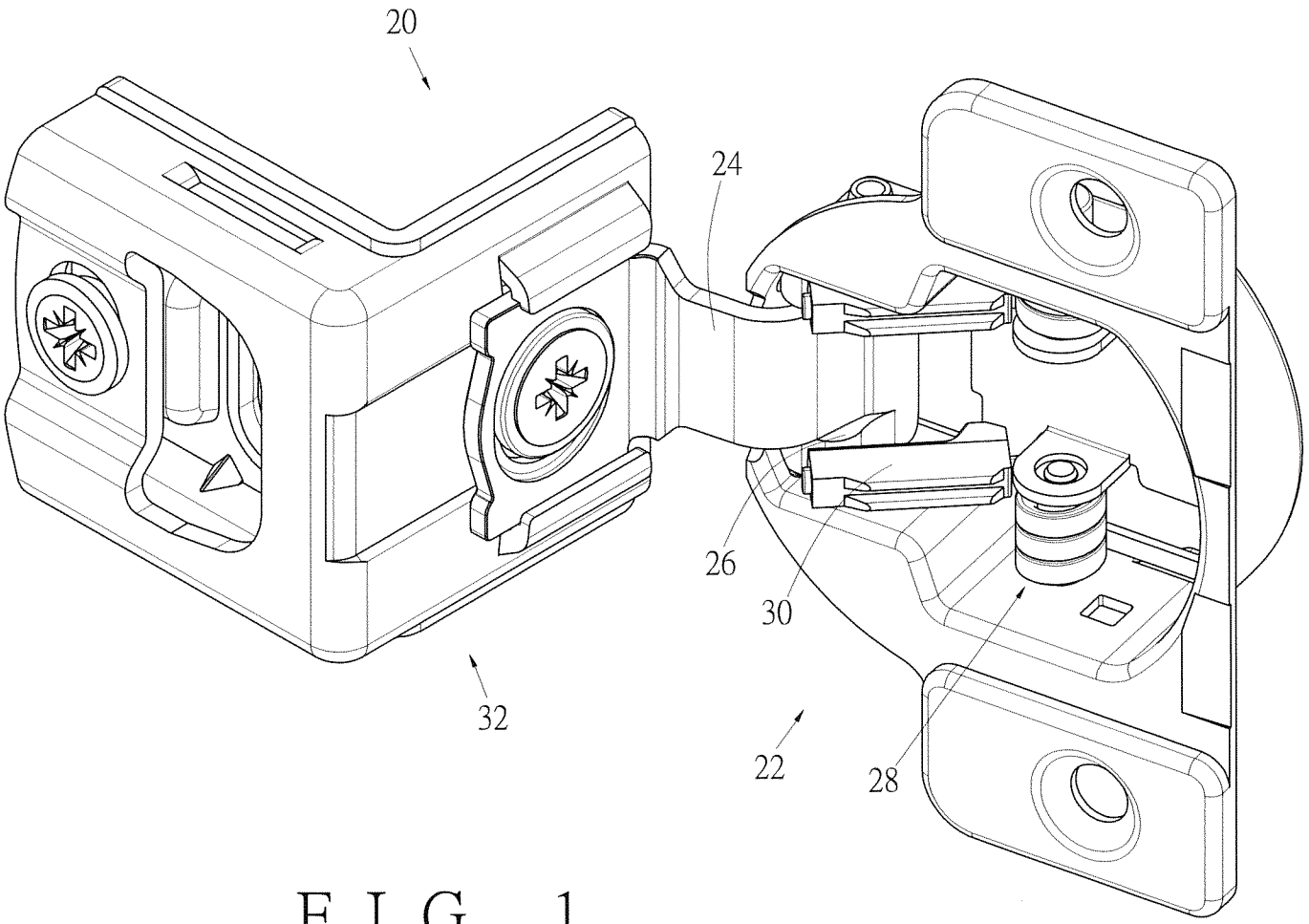
FIG. 1 is a perspective view of the hinge device according to an embodiment of the present invention.

Referring to FIG. 1, a hinge device 20 according to an embodiment of the present invention includes a first fitting 22, a connecting arm 24 pivotally connected to the first fitting 22, a cam 26 located at the connecting arm 24, an elastic member 28 mounted to the first fitting 22, and a sleeve member 30 attached to a portion of the elastic member 28 and in contact with the cam 26. In this embodiment, the hinge device 20 further includes a second fitting 32 connected to the connecting arm 24. Please note that the hinge device 20 in this embodiment includes a pair of cams 26, a pair of elastic members 28, and a pair of sleeve members 30 by way of example only; the cam 26, the elastic member 28, and the sleeve member 30 need not be provided in pairs.

Figure 2B:
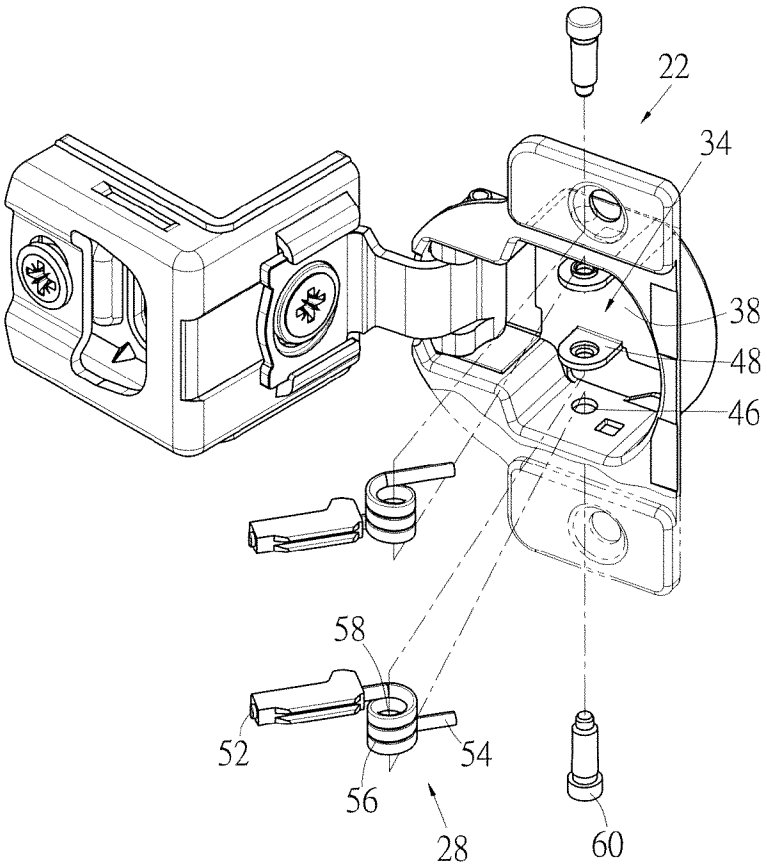
FIG. 2B is an exploded view showing the sleeve member attached to each elastic member of the hinge device in FIG. 1 and how each elastic member is mounted to the first fitting via a connecting member.
Figure 2A:
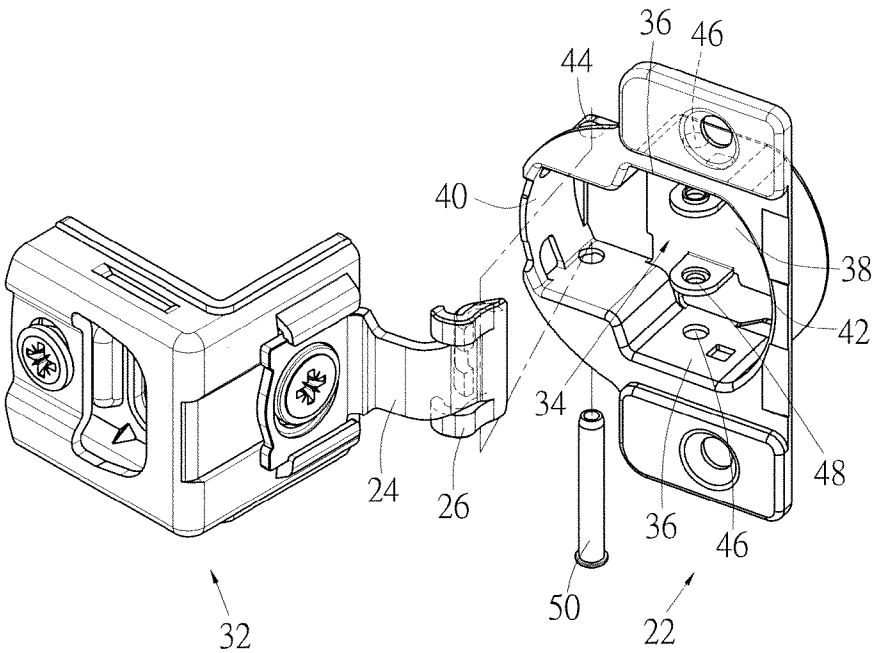
FIG. 2A is an exploded view showing how the two fittings and the connecting arm of the hinge device in FIG. 1 are connected together via a pivotal connecting member.

As shown in FIG. 2A, the first fitting 22 includes a receiving room 34 defined by a plurality of walls. For example, the first fitting 22 has a pair of sidewalls 36, a bottom wall 38 connected between the sidewalls 36, a front wall 40 connected to the front ends of the sidewalls 36, and a rear wall 42 connected to the rear ends of the sidewalls 36. Each sidewall 36 has a pivot hole 44 and a connecting hole 46. The bottom wall 38 has a pair of lugs 48.

The connecting arm 24 has two end portions, one of which is connected to the first fitting 22 and the other of which is connected to the second fitting 32. A pivotal connecting member 50 is passed through the connecting arm 24 and the pivot holes 44 to pivotally connect the connecting arm 24 and the first fitting 22, thus allowing the first fitting 22 to pivot with respect to the connecting arm 24 (or the second fitting 32).

The pair of cams 26 are located on two lateral sides of the connecting arm 24 respectively and can be connected to or formed integrally with the connecting arm 24.

As shown in FIG. 2B, each elastic member 28 includes a first end portion 52. In this embodiment, each elastic member 28 further includes a second end portion 54 and a coil portion 56, wherein the coil portion 56 is coiled and is connected between the end portions 52 and 54. The coil portion 56 of each elastic member 28 defines a mounting hole 58 corresponding to one connecting hole 46 of the first fitting 22. Each elastic member 28 is mounted to one lug 48 of the first fitting 22 with a connecting member 60 passing through its mounting hole 58 and the corresponding connecting hole 46. Once mounted, each elastic member 28 is located in the receiving room 34 of the first fitting 22 and has its second end portion 54 pressed against a portion of the first fitting 22, such as the wall surface of the bottom wall 38 which faces the receiving room 34.

Figure 3A:
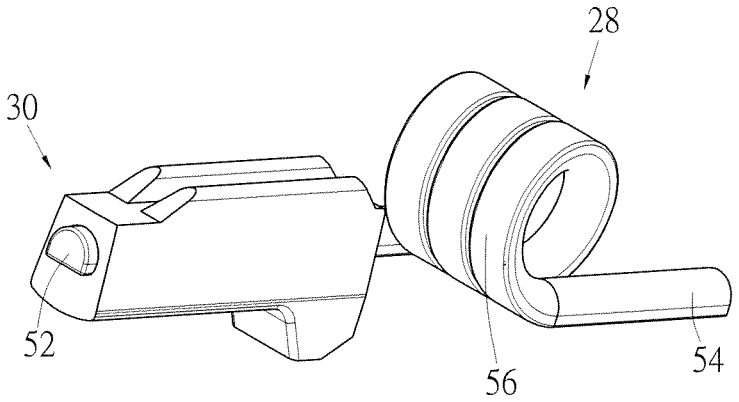
FIG. 3A is an assembled view of an elastic member and the corresponding sleeve member of the hinge device of FIG. 1, wherein the elastic member has an end portion with a non-circular cross section.
Figure 3B:
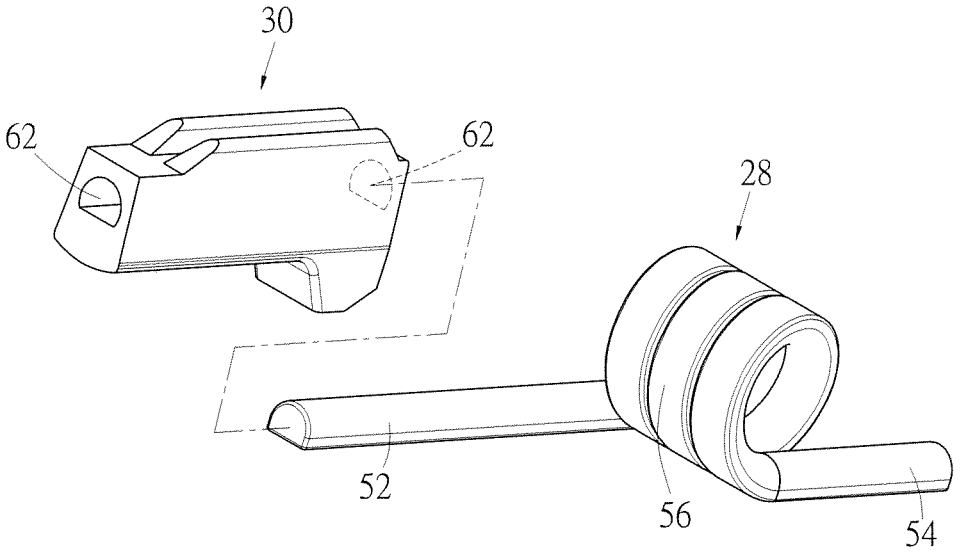
FIG. 3B is an exploded view of the elastic member and the sleeve member in FIG. 3A.

FIG. 3A and FIG. 3B show how each sleeve member 30 is arranged in relation to the corresponding elastic member 28. As shown in the drawings, the first end portion 52 of the elastic member 28 has a non-circular cross section. In other words, the cross section of the first end portion 52 is not circular. By way of example only, the cross section of the first end portion 52 may be D-shaped. The sleeve member 30, on the other hand, includes a cavity 62 through which the first end portion 52 of the elastic member 28 can pass and in which the first end portion 52 of the elastic member 28 can be mounted. The cavity 62, for example, is a non-circular cavity. The sleeve member 30 can be made of a wear-resistant plastic material. Owing to the non-circular cross section of the first end portion 52 of the elastic member 28, the sleeve member 30 can be effectively held in position in the peripheral direction of the first end portion 52 of the elastic member 28.

It is worth mentioning that each elastic member 28 can be so manufactured that it has a non-circular cross section throughout, meaning the cross section of the entire elastic member 28, including portions other than the first end portion 52, can be non-circular. More specifically, both end portions 52 and 54 and the coil portion 56 of the elastic member 28 may have a non-circular cross section.

Figure 4B:
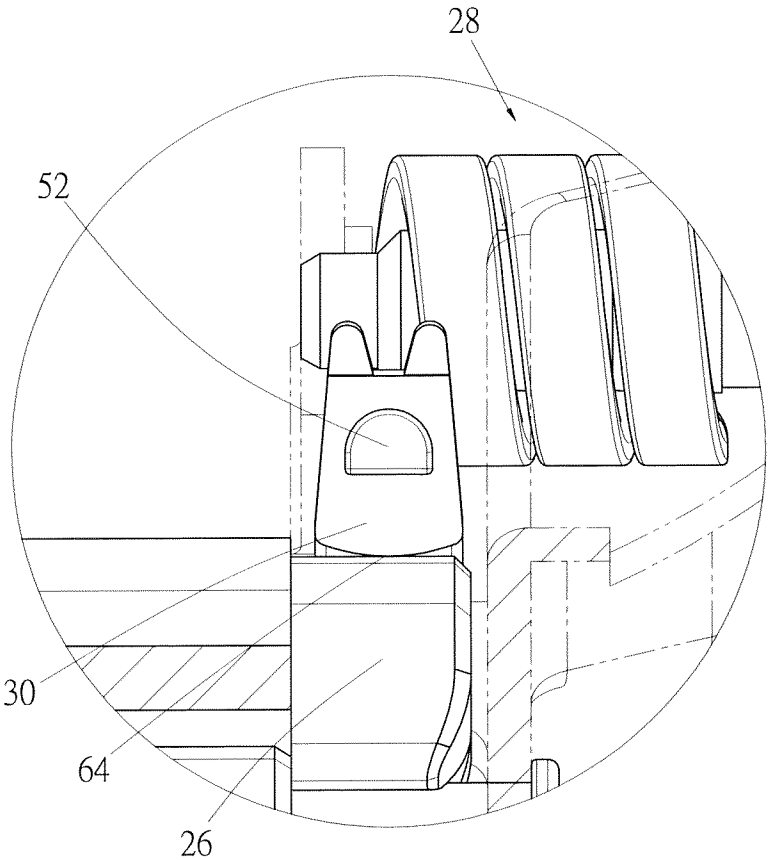
FIG. 4B is a partial enlarged view of FIG. 4A, showing that the sleeve member has a curved surface in contact with the cam.
Figure 4A:
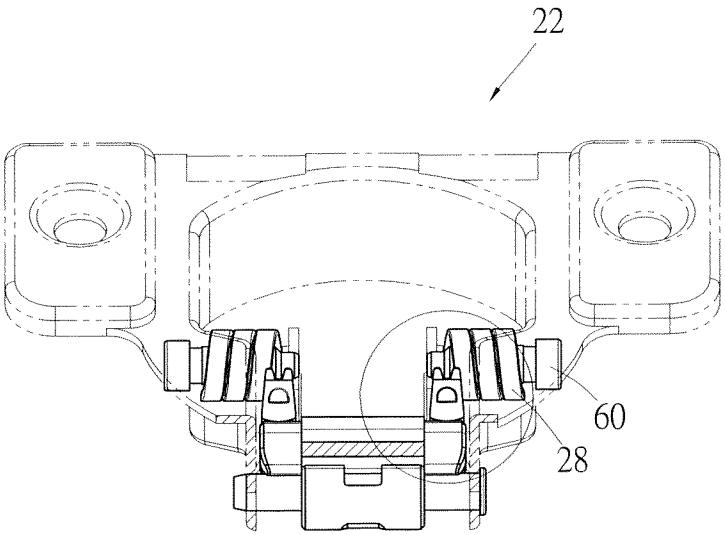
FIG. 4A shows how the elastic members of the hinge device in FIG. 1 are mounted to the first fitting and how the elastic members come into contact with the cams via the corresponding sleeve members respectively.

Referring to FIG. 4A and FIG. 4B, each elastic member 28 is mounted to the first fitting 22 via the corresponding connecting member 60, and the first end portion 52 of each elastic member 28 is in contact with the corresponding cam 26 via the corresponding sleeve member 30. Each sleeve member 30 may have a curved surface 64 for contact with the corresponding cam 26.

Figure 5B:
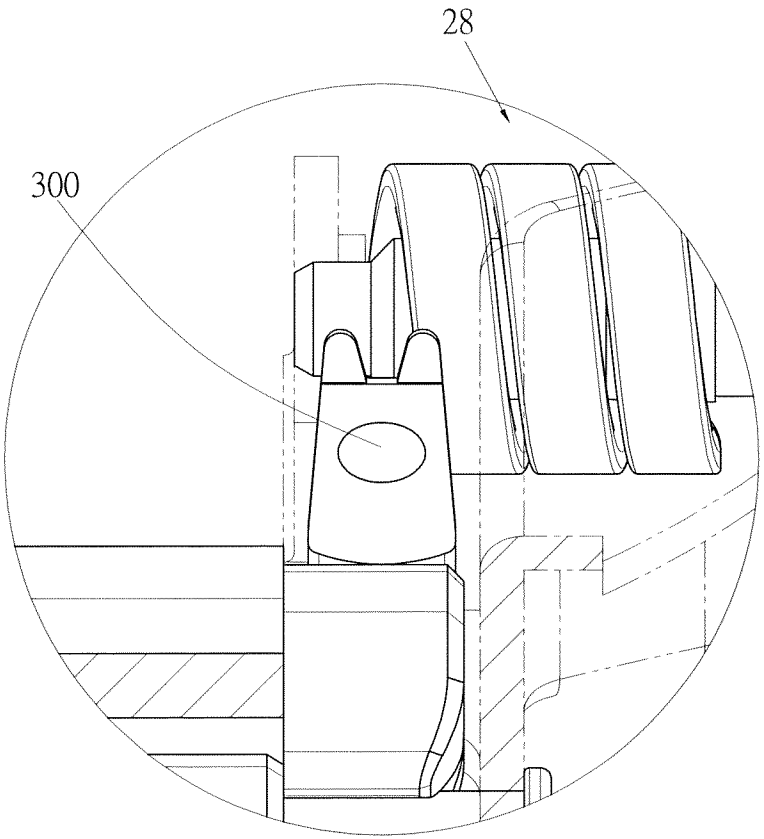
FIG. 5B shows an elastic member of the hinge device according to yet another embodiment of the present invention, wherein the elastic member has an end portion with an elliptic cross section.
Figure 5A:
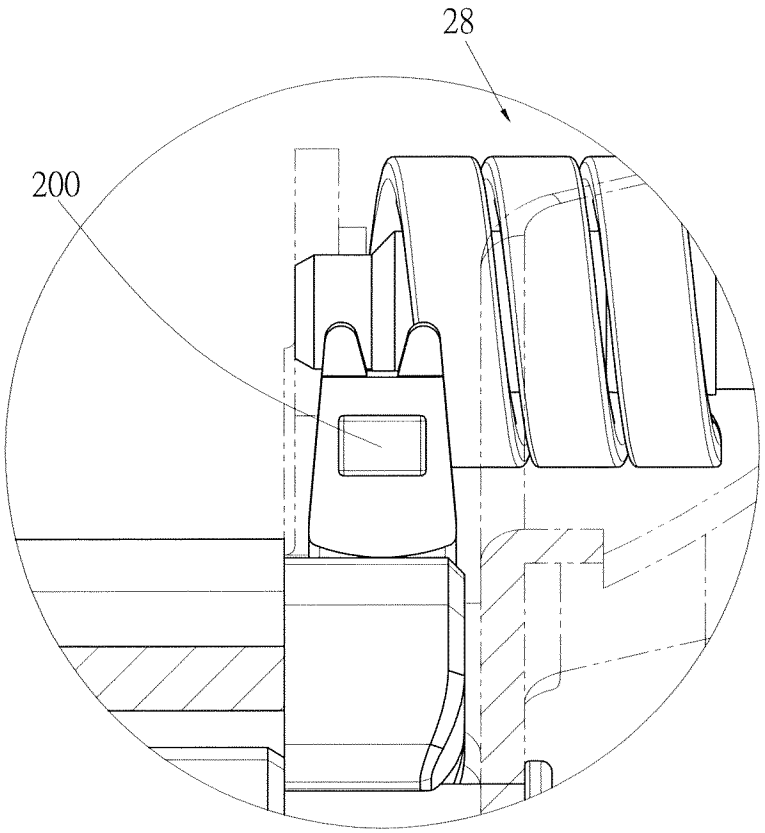
FIG. 5A shows an elastic member of the hinge device according to another embodiment of the present invention, wherein the elastic member has an end portion with a rectangular cross section.

Referring to FIG. 5A and FIG. 5B, the first end portion of each elastic member 28 may have a square or rectangular cross section (e.g., the first end portion 200 shown in FIG. 5A) or an elliptic cross section (e.g., the first end portion 300 shown in FIG. 5B). In practice, there are no limitations on the shape of the non-circular cross section.

Figure 6:
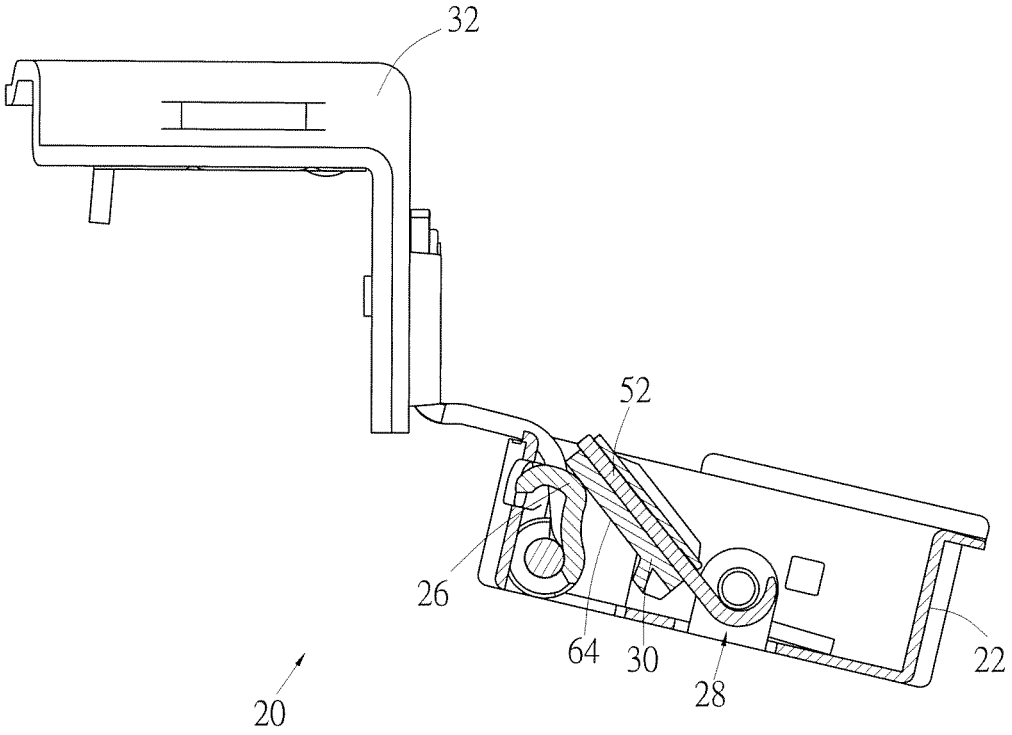
FIG. 6 shows how each cam of the hinge device in FIG. 1 is in contact with a surface of the corresponding sleeve member.

As shown in FIG. 6, each cam 26 of the hinge device 20 is in contact with a surface (e.g., the curved surface 64) of the corresponding sleeve member 30 and can be displaced along the surface in the length direction of the end portion 52 of the corresponding elastic member 28 such that an opening force or a closing force can be generated between the first fitting 22 and the second fitting 32 of the hinge device 20.

Figure 7B:
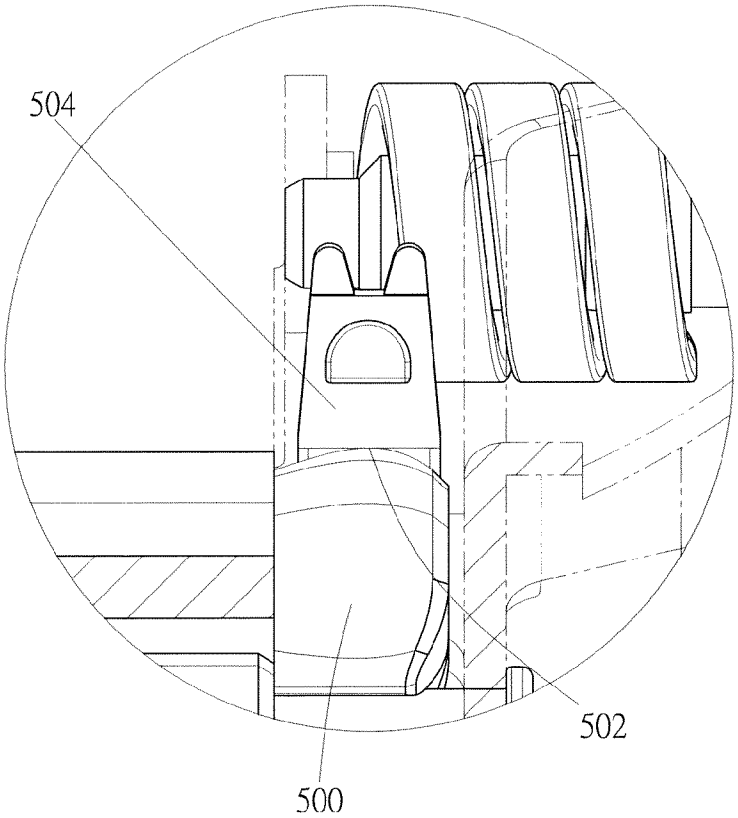
FIG. 7B shows how a sleeve member of the hinge device according to a further embodiment of the present invention is in contact with the corresponding cam.
Figure 7A:
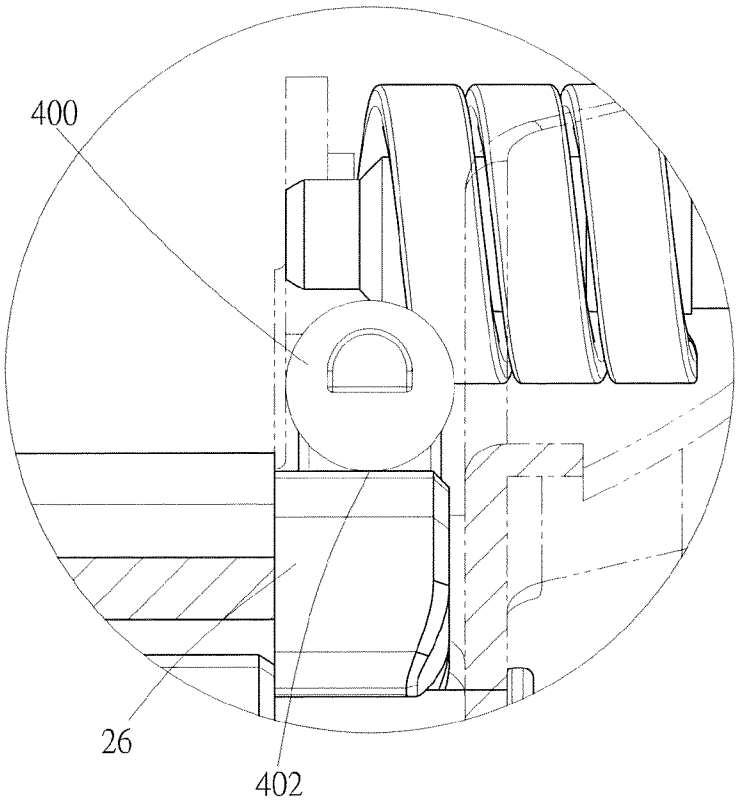
FIG. 7A shows how a sleeve member of the hinge device according to still another embodiment of the present invention is in contact with the corresponding cam.

Referring to FIG. 7A, in another embodiment of the present invention, the sleeve member 400 has a cylindrical cross section and has a curved surface 402 for contact with the cam 26. Referring to FIG. 7B, in yet another embodiment of the present invention, the cam 500 has a curved surface 502 for contact with the sleeve member 504.

Figure 8B:
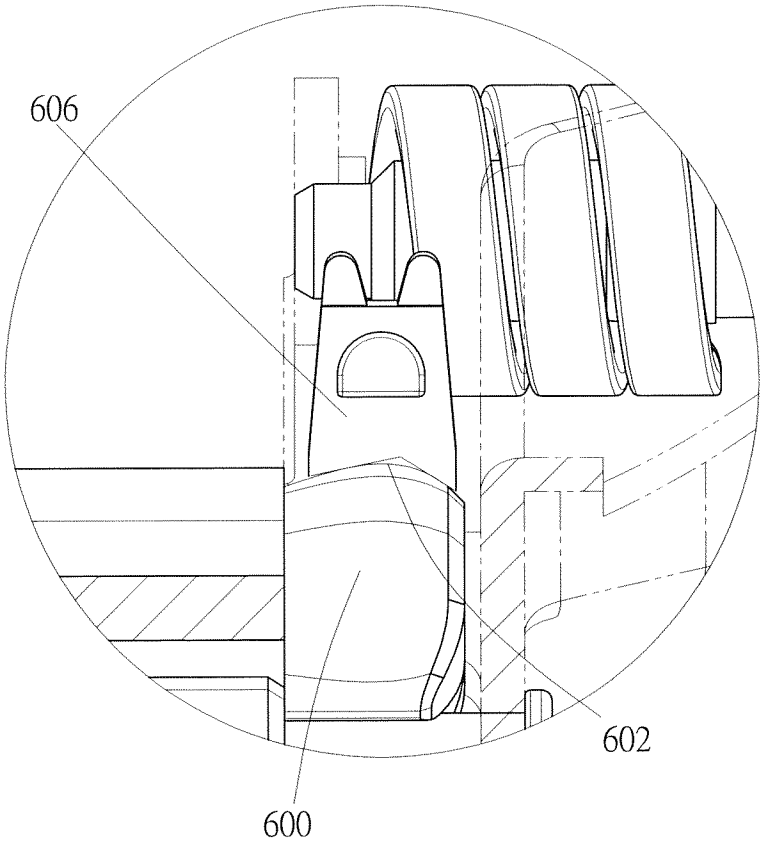
FIG. 8B shows how a sleeve member of the hinge device according to still another embodiment of the present invention is in contact with the corresponding cam.
Figure 8A:
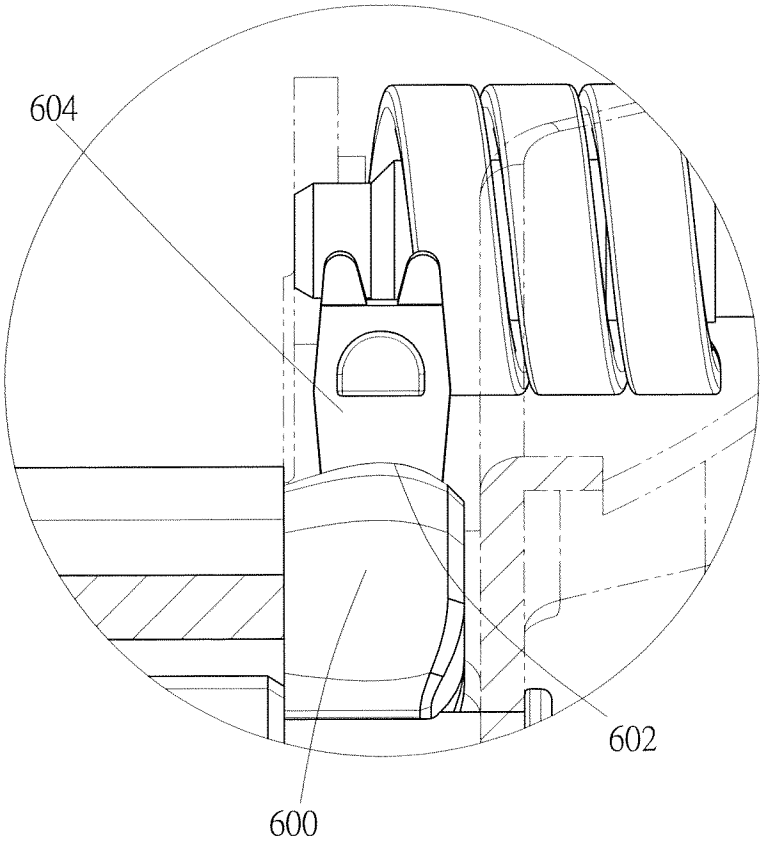
FIG. 8A shows how a sleeve member of the hinge device according to yet another embodiment of the present invention is in contact with the corresponding cam.

Referring to FIG. 8A, in still another embodiment of the present invention, the cam 600 has a curved surface 602 while the sleeve member 604 has a concavely curved surface corresponding to the curved surface 602 of the cam 600. Referring to FIG. 8B, in further embodiment of the present invention, the sleeve member 606 has a generally V-shaped surface for contact with the curved surface 602 of the cam 600.

Figure 9A:
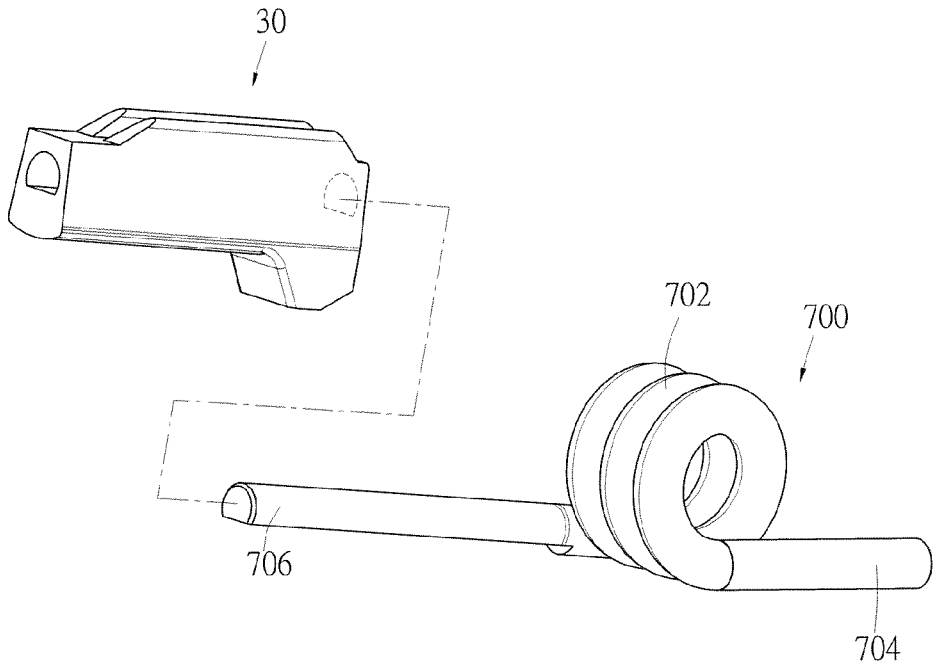
FIG. 9A is an exploded view of an elastic member and the corresponding sleeve member of the hinge device according to a further embodiment of the present invention.
Figure 9B:
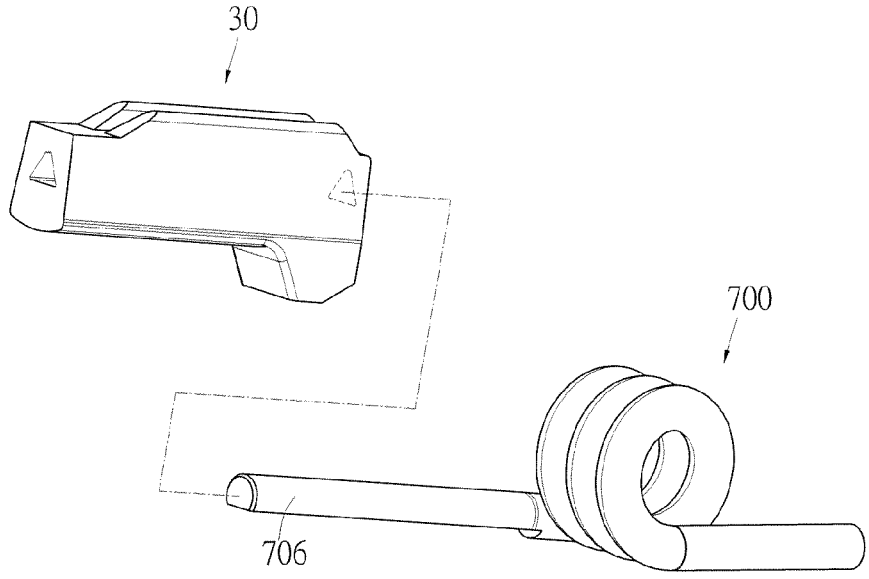
FIG. 9B is an exploded view of an elastic member and the corresponding sleeve member of the hinge device according to yet another embodiment of the present invention.

As shown in FIG. 9A and FIG. 9B, in another embodiment of the present invention, the coil portion 702 and the second end portion 704 of the elastic member 700 are generally circular in cross section while the first end portion 706 of the elastic member 700 has a non-circular cross section corresponding to the cavity of the sleeve member 30, wherein the cavity may be a non-circular one such as a D-shaped cavity (see FIG. 9A) or a triangular cavity (see FIG. 9B), without limitation.

Figure 10A:
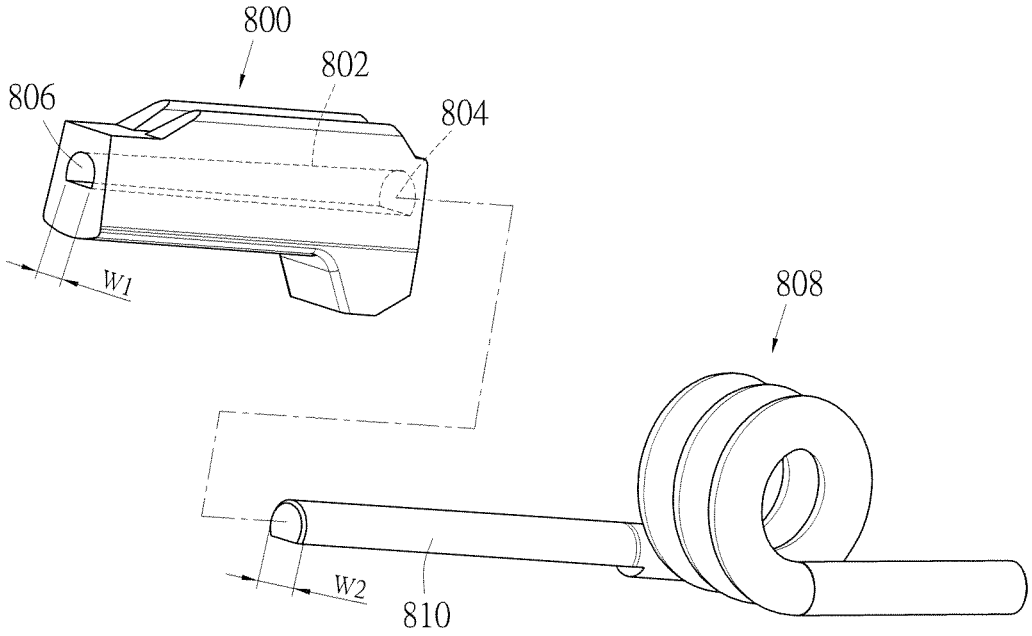
FIG. 10A is an exploded view of an elastic member and the corresponding sleeve member of the hinge device according to still another embodiment of the present invention.
Figure 10B:
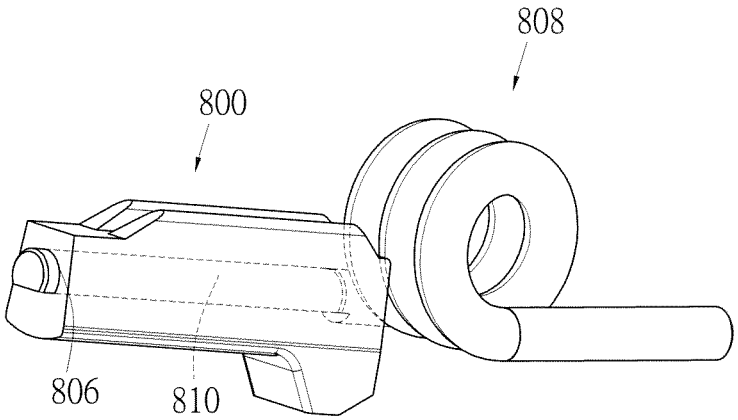
FIG. 10B is an assembled view of the elastic member and the sleeve member in FIG. 10A.

Referring to FIG. 10A, in yet another embodiment of the present invention, the cavity 802 of the sleeve member 800 includes a first portion 804 and a second portion 806. The first portion 804 has a greater diameter than the second portion 806, and the width W1 of the second portion 806 is less than the width W2 of the first end portion 810 of the elastic member 808. Accordingly, referring to FIG. 10B, after being inserted through the first portion 804 of the sleeve member 800 to a position adjacent to the second portion 806, the first end portion 810 of the elastic member 808 is restrained in the peripheral direction and is therefore blocked in the cavity 802 at a position adjacent to the second portion 806. Thus, the first end portion 810 of the elastic member 808 is securely mounted in the cavity 802 of the sleeve member 800.

Figure 11:
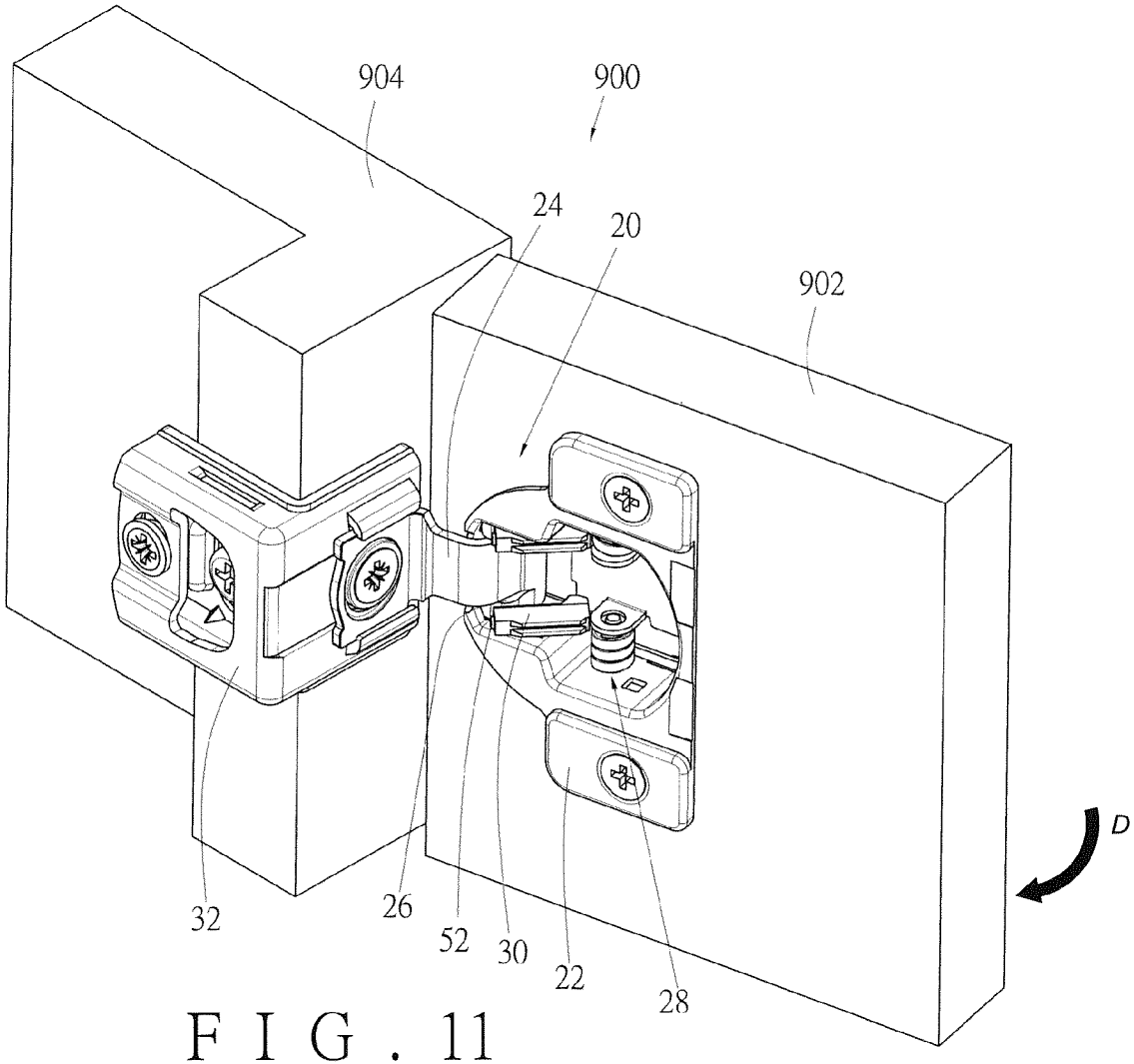
FIG. 11 shows how the hinge device in FIG. 1 is applied to a piece of furniture.

FIG. 11 shows how the hinge device 20 according to an embodiment of the present invention is mounted to a piece of furniture 900. The furniture 900 includes a first furniture member 902 and a second furniture member 904, wherein the first furniture member 902 can be opened or closed with respect to the second furniture member 904. The first fitting 22 of the hinge device 20 is mounted to the first furniture member 902 while the second fitting 32 is mounted to the second furniture member 904. As the first fitting 22 is pivotally connected to the connecting arm 24, the first furniture member 902 can be brought into an opened state with respect to the connecting arm 24 (or the second fitting 32) via the first fitting 22, and when the first fitting 22 is pivoted by an external force in a closing direction D with respect to the connecting arm 24 (or the second fitting 32), the elastic members 28 provide an elastic closing force such that, with the sleeve members 30 in movable contact with their respective cams 26, the first fitting 22 can be further driven to pivot with respect to the connecting arm 24 by the elastic force generated by the elastic members 28.

While the present invention has been disclosed by way of the preferred embodiments described above, the embodiments are not intended to be restrictive of the present invention. The scope of patent protection sought by the applicant is defined by the appended claims.

The invention claimed is:

1. A hinge device, comprising:
a fitting;
a connecting arm pivotally connected to the fitting;
a cam located at the connecting arm;
an elastic member mounted to the fitting, the elastic member including an end portion having a non-circular cross section; and
a sleeve member attached to the elastic member and in contact with the cam, the sleeve member including a cavity in which the end portion of the elastic member can be mounted;
wherein the cavity of the sleeve member includes a first portion and a second portion, and the first portion has a greater diameter than the second portion.

2. The hinge device of claim 1, further including another fitting connected to the connecting arm.

3. The hinge device of claim 1, wherein the elastic member further includes another end portion and a coil portion, and the coil portion is connected between the end portion and said another end portion.

4. The hinge device of claim 3, wherein the coil portion of the elastic member defines a mounting hole, and the hinge device further includes a connecting member extending through the mounting hole in order to mount the elastic member to the fitting.

5. The hinge device of claim 3, wherein said another end portion of the elastic member is pressed against the fitting.

6. The hinge device of claim 1, wherein the elastic member includes a portion other than the end portion and having a non-circular cross section.

7. The hinge device of claim 1, wherein the cavity of the sleeve member is a non-circular cavity.

8. The hinge device of claim 1, wherein the second portion has a width less than a width of the end portion of the elastic member.

9. A hinge device adapted to be mounted to a piece of furniture, the furniture including a first furniture member and a second furniture member, the hinge device comprising:
a first fitting mounted to the first furniture member;
a second fitting mounted to the second furniture member;
a connecting arm pivotally connecting the first fitting and the second fitting;
a cam located at the connecting arm;
an elastic member mounted to one of the first fitting and the second fitting, the elastic member including an end portion having a non-circular cross section; and
a sleeve member attached to the elastic member and in contact with the cam, the sleeve member including a cavity in which the end portion of the elastic member can be mounted;
wherein the cavity of the sleeve member includes a first portion and a second portion, and the first portion has a greater diameter than the second portion.

10. The hinge device of claim 9, wherein the elastic member further includes another end portion and a coil portion, and the coil portion is connected between the end portion and said another end portion.

11. The hinge device of claim 10, wherein the coil portion of the elastic member defines a mounting hole, and the hinge device further includes a connecting member extending through the mounting hole in order to mount the elastic member to the one of the first fitting and the second fitting.

12. The hinge device of claim 9, wherein the elastic member includes a portion other than the end portion and having a non-circular cross section.

13. The hinge device of claim 9, wherein the cavity of the sleeve member is a non-circular cavity.

14. The hinge device of claim 9, wherein the second portion has a width less than a width of the end portion of the elastic member.

* * * * *